US011358761B2

(12) United States Patent
Huang

(10) Patent No.: US 11,358,761 B2
(45) Date of Patent: Jun. 14, 2022

(54) CONVENIENT LID

(71) Applicant: Liming Huang, Shenzhen (CN)

(72) Inventor: Liming Huang, Shenzhen (CN)

( * ) Notice: Subject to any disclaimer, the term of this patent is extended or adjusted under 35 U.S.C. 154(b) by 0 days.

(21) Appl. No.: 16/944,188

(22) Filed: Jul. 31, 2020

(65) Prior Publication Data

US 2020/0361670 A1 Nov. 19, 2020

Related U.S. Application Data

(63) Continuation-in-part of application No. 15/939,272, filed on Mar. 28, 2018, now abandoned.

(51) Int. Cl.

| | |
|---|---|
| ***B65D 47/24*** | (2006.01) |
| ***A47G 19/22*** | (2006.01) |
| ***B65D 45/02*** | (2006.01) |
| ***B65D 47/08*** | (2006.01) |
| ***B65D 43/26*** | (2006.01) |

(52) U.S. Cl.

CPC ..... *B65D 47/245* (2013.01); *A47G 19/2272* (2013.01); *B65D 43/26* (2013.01); *B65D 43/265* (2013.01); *B65D 45/025* (2013.01); *B65D 47/0866* (2013.01); *B65D 47/248* (2013.01); *B65D 47/249* (2013.01); *B65D 2543/00046* (2013.01)

(58) Field of Classification Search

CPC ..... B65D 45/025; B65D 47/0866; B65D 47/249; B65D 47/248; B65D 43/26; B65D 47/2093; B65D 47/245; B65D 2543/00046; B65D 43/24; B65D 43/265; A47G 19/2272

USPC ..... 220/715

See application file for complete search history.

(56) References Cited

U.S. PATENT DOCUMENTS

| | | | | |
|---|---|---|---|---|
| 6,098,834 | A * | 8/2000 | Hatsumoto | B65D 47/249 220/715 |
| 2012/0118890 | A1* | 5/2012 | Gilbert | B65D 43/0225 220/254.9 |
| 2013/0119060 | A1* | 5/2013 | Chiou | B65D 43/267 220/254.3 |
| 2014/0197170 | A1* | 7/2014 | Carlile | B65D 47/249 220/262 |
| 2015/0201776 | A1* | 7/2015 | Elsaden | B65D 47/248 220/715 |
| 2017/0253395 | A1* | 9/2017 | Matthis | A45F 3/16 |
| 2018/0215514 | A1* | 8/2018 | Wodka | B65D 47/32 |

* cited by examiner

*Primary Examiner* — Don M Anderson
*Assistant Examiner* — Jennifer Castriotta
(74) *Attorney, Agent, or Firm* — Bayramoglu Law Offices LLC

(57) ABSTRACT

A convenient lid includes a housing, a lid opening, a press plate, a button, an insertion plate, a guide plate and a threaded body, the lid opening and the threaded body are provided on the lower part of the housing, the side of the lid is provided with a first concave cavity, a fixing body and a guide column are provided in the first concave cavity, a switch device and a security device are provided on the fixing body and the guide column, a guide plate, an insertion plate and a press plate are provided inside the lid, a concave ring and a guide strip are provided on the outside of the lid opening, a convex ring, a guide slot and a latch are provided on the inner side of the threaded body, ribs and threads are provided on the outer side of the threaded body.

7 Claims, 11 Drawing Sheets

CONVENIENT LID

CROSS REFERENCE TO THE RELATED APPLICATIONS

The present application is a continuation-in-part application of U.S. patent application Ser. No. 15/939,272, filed on Mar. 28, 2018, which is a continuation of International Patent Application No. PCT/CN2018/072124, filed on Jan. 10, 2018, the entire contents of which is incorporated herein by reference.

TECHNICAL FIELD

The present disclosure relates to an accessory for tea sets, and in particular, to a convenient lid for various thermal insulated containers.

BACKGROUND

With the development of society, economic prosperity, and improvement of living standards, people work, surfing the Internet, and chat, with increasingly demands for quality of life. Leisure travel and outdoor sports are increasing. Drinking tea is also an indispensable part of people's lives. Therefore, a lid for a thermal insulated container, with a security switch, is popular among people, such as a lid patent with the application No. ZL201320246931.0 filed before the CNIPA China, which is anti-fragile and leak-proof. However, during tea drinking, the lid requires both hands to uncover, that is, people first press the security switch and then uncover the lid to drink tea, which cannot meet the different needs of those who live fast or busy.

SUMMARY

In order to overcome the deficiencies of the above problems, the present disclosure provides a convenient lid. With the convenient lid, people need to use only one hand to hold the thermal insulated container, press down the press plate on the lid with the thumb, slide the button downwards, and then uncover the lid switch, to drink tea. After the thumb moves away, the lid switch will automatically lock, and also the switch can be automatically secured. In order to firmly bond the container and the threaded body without leak, a concave ring and a guide strip are provided in the lid opening, and a convex ring and a guide slot are provided on the threaded body, and the threaded body is pressed into the lid opening using the principle of thermal expansion and contraction of plastic. In order to open the security device and the switch with one hand, the security device is placed in the switch device. In order to facilitate the cleaning of the dirt on the lid, all the accessories in the lid are placed on the insertion plate. To facilitate disassembly, the insertion plate and the guide plate are combined in a movable manner, which is convenient, clean and leak-proof.

The technical solution adopted by the present disclosure to solve the technical problems is: a convenient lid, comprising a housing, a lid opening, a press plate, a button, an insertion plate, a guide plate and a threaded body, a water outlet and a press buckle being provided on the upper part of the housing, the press buckle being provided with a buckle foot, the lid opening and the threaded body being provided on the lower part of the housing, the side of the lid being provided with a concave cavity, a fixing body and a guide column being provided in the concave cavity, a switch device and a security device being provided on the fixing body and the guide column, a guide plate, an insertion plate and a press plate being provided inside the lid, a concave ring and a guide strip being provided on the outside of the lid opening, a convex ring, a guide slot and a latch being provided on the inner side of the threaded body, the threaded body being provided on the outside of the lid opening, the convex ring is connected with the concave ring of the lid opening, the guide slot being connected with the guide strip of the lid opening, the concave ring of the lid opening being engaged with the convex ring of the threaded body so as to prevent the separation of the threaded body from the lid opening, the guide strip of the lid opening being engaged with the guide slot of the threaded body so as to prevent the rotation of the threaded body on the lid opening, ribs and threads being provided on the outer side of the threaded body; the press buckle being provided above the vent; the switch device being composed of a press plate and a movable shaft, a retaining ring being provided at the front end of the movable shaft, a top ring and a slot column being provided in the middle of the movable shaft, and a seal block, a first spring and a movable plate being provided at the rear portion of the movable shaft, the seal block being provided with a seal ring; a rubber ring being provided between the top ring and the slot column, wherein the rubber ring can be installed or removed without the need for tools and the switch device can be directly assembled or disassembled by hand; a first spring being provided on the slot column; the guide plate being provided with a long slot; an insertion body being provided within the long slot, the top ring and the retaining ring being provided on the guide plate; the guide plate being provided in the housing; the security device being composed of a button and a movable plate and being provided in the press plate; a second concave cavity being provided on the press plate, a button being provided on the second concave cavity, and a blocking plate, a fixing column and a square hole being provided on the movable plate; a second spring being provided on the fixing column; the button being provided with a non-slip strip and a square body, the square body being connected with the square hole on the movable plate, one end of the buckle plate being provided with a shaft hole and the other end being provided with a card slot; the insertion plate being provided with a circular hole at one end thereof, an insertion body at the other end of the insertion plate, and a rotating shaft in the middle of the insertion plate, the rotating shaft being connected with the shaft hole of the buckle plate, the insertion body being connected with the guide plate inside the lid, and the insertion plate being connected with the top plate; the top plate being provided with a soft edge and a pin, the pin being connected with the circular hole on the insertion plate, the soft edge being provided on the back of the water outlet, and the card slot on the buckle plate being fastened on the latch of the lid.

The advantage of the present disclosure is that with the convenient lid, people only need to use one hand to hold the thermal insulated container, press down the press plate on the lid with the thumb, slide the button downwards, and then uncover the lid switch to drink tea. After the thumb moves away, the lid switch will automatically lock, and also the switch can be automatically secured. In order to firmly bond the container and threaded body without leak, a concave ring and a guide strip are provided in the lid opening, and a convex ring and a guide slot are provided on the threaded body, and the threaded body is pressed into the lid opening using the principle of thermal expansion and contraction of plastic. In order to open the security device and the switch with one hand, the security device is placed in the switch device. In order to facilitate the cleaning of the dirt on the lid, all the accessories in the lid are placed on the insertion plate. To facilitate disassembly, the insertion plate and the guide plate are combined in a movable manner, which is convenient, clean and leak-proof.

Figure 1:
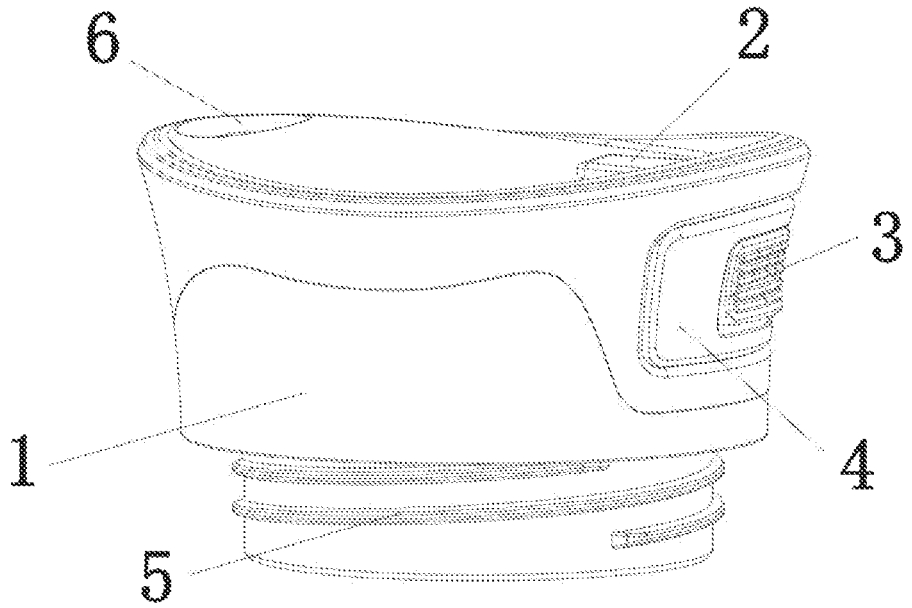
FIG. 1 is a schematic structural view of the present disclosure.
Figure 2:
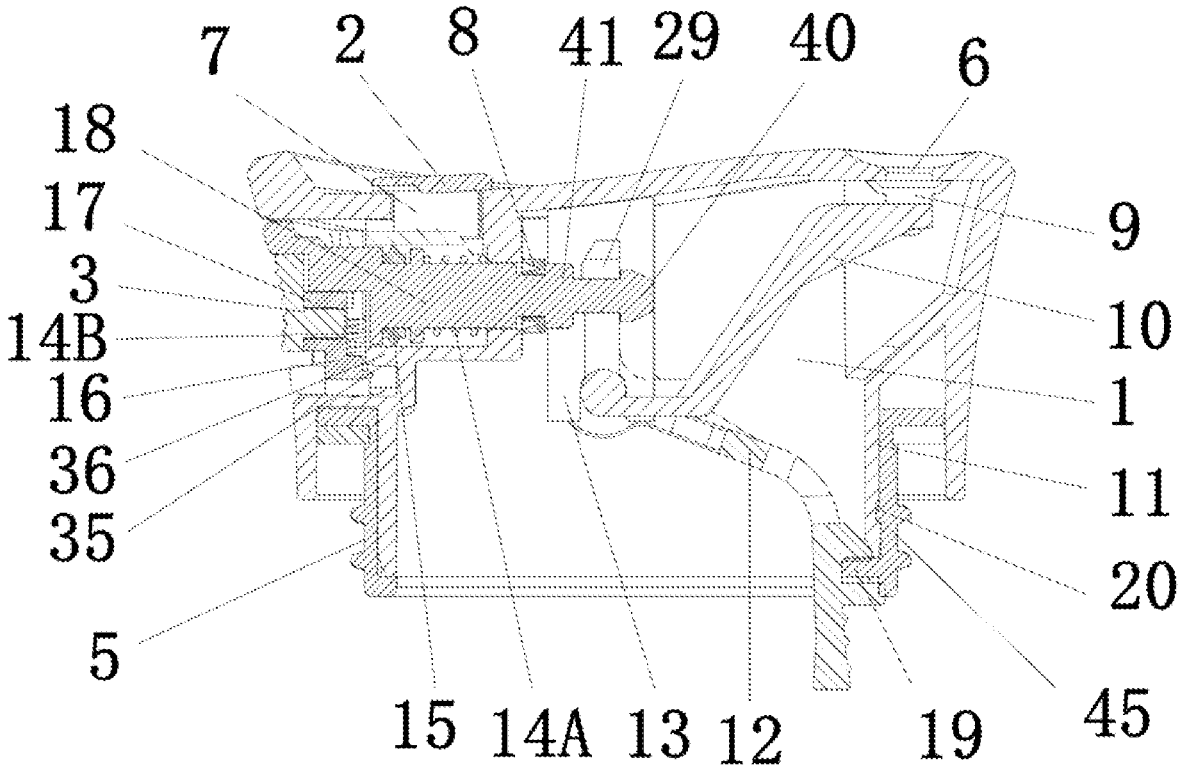
FIG. 2 is a sectional view of the present disclosure.
Figure 3:
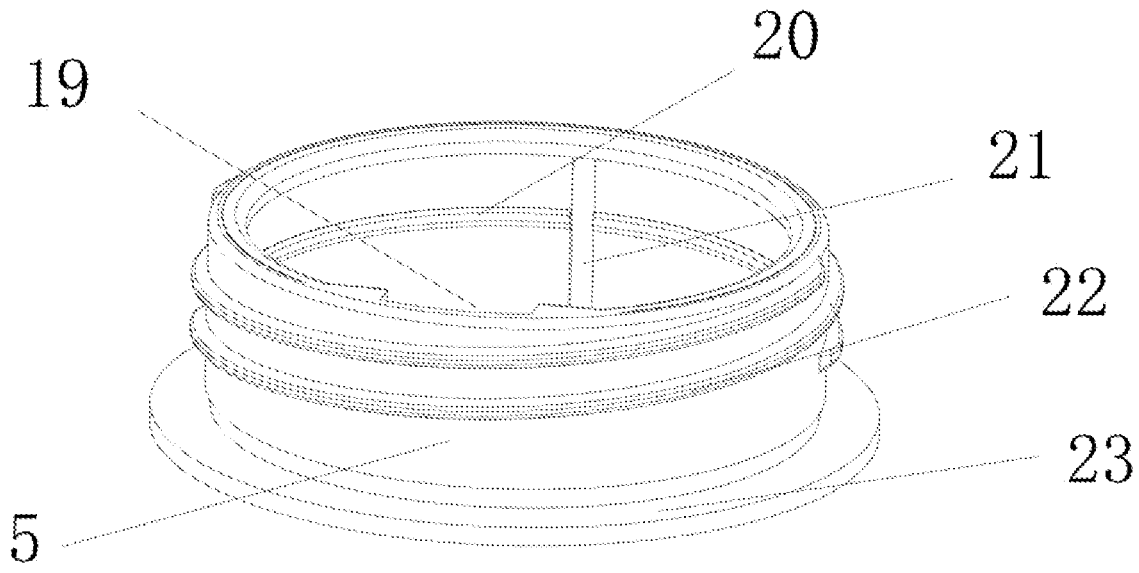
FIG. 3 is a first schematic structural view of a threaded body in the present disclosure.
Figure 4:
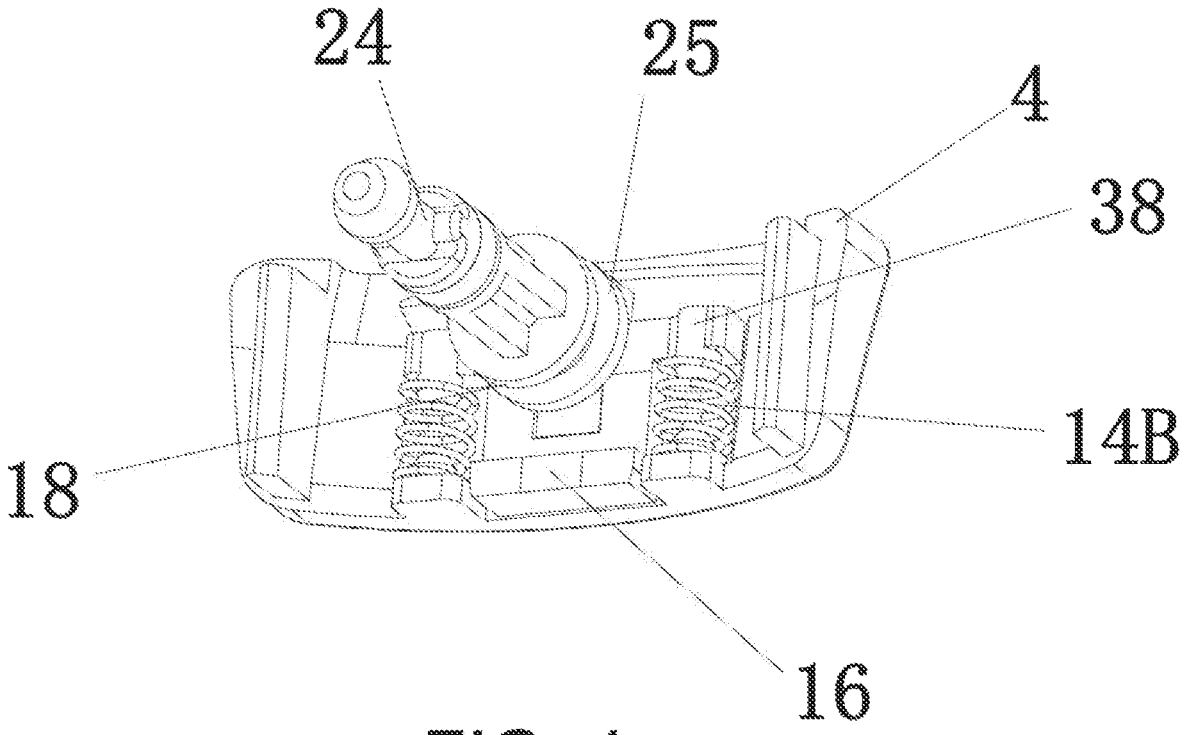
FIG. 4 is a schematic structural view of a switch device in the present disclosure.
Figure 5:
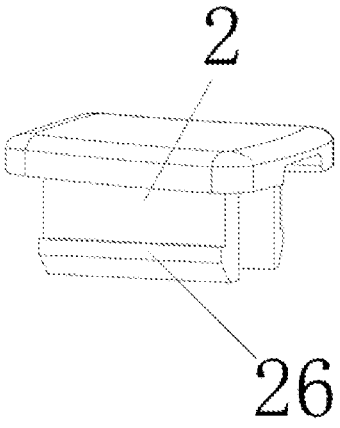
FIG. 5 is a schematic structural view of a press buckle in the present disclosure.
Figure 6A:
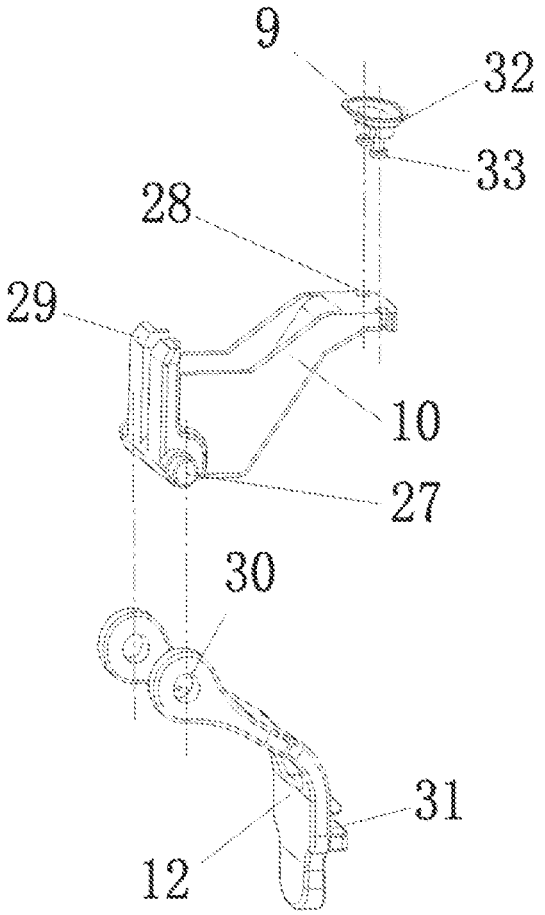
FIG. 6A is a first exploded view showing an insertion body and a buckle plate in the present disclosure.
Figure 6B:
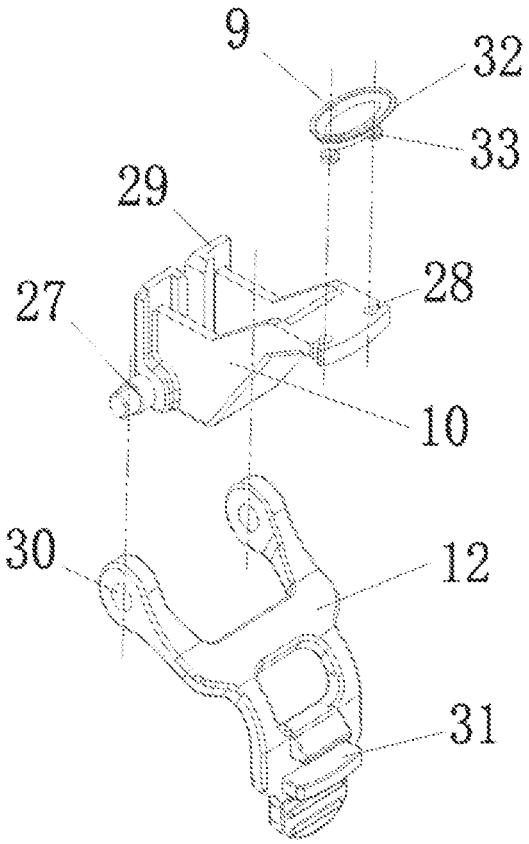
FIG. 6B is a second exploded view showing an insertion body and a buckle plate in the present disclosure.

Reference signs in the drawings: 1, housing; 2, press buckle; 3, button; 4, press plate; 5, threaded body; 6, water outlet; 7, vent; 8, rubber ring; 9, top plate; 10, insertion plate; 11, lid opening; 12, buckle plate; 13, guide plate; 14A, first spring; 14B, second spring; 15, seal ring; 16, movable plate; 17, security device; 18, switch device; 19, latch; 20, convex ring; 21, guide slot; 22, thread; 23, rib; 24, movable shaft; 25, seal block; 26, buckle foot; 27, rotating shaft; 28, circular hole; 29, insertion body; 30, shaft hole; 31, card slot; 32, soft edge; 33, pin; 34A, first concave cavity; 34B, second concave cavity; 35, guide column; 36, fixing body; 37, square hole; 38, fixing column; 39, blocking plate; 40, retaining ring; 41, top ring; 42, slot column; 43, non-slip strip; 44, square body; 45, concave ring; 46, guide strip.

DETAILED DESCRIPTION OF THE EMBODIMENTS

The following examples are intended to illustrate the present disclosure but are not intended to limit the scope of the present disclosure.

As shown in FIG. 1-FIG. 11B, a convenient lid includes a housing 1. A water outlet 6 and a press buckle 2 are provided on the upper part of the housing 1. The press buckle 2 is connected to a buckle foot 26. The lower part of the housing 1 is connected to a lid opening 11 and has a threaded body 5 provided thereon. The side of the housing 1 has a first concave cavity 34A in which a fixing body 36 and a guide column 35 are installed. The fixing body 36 may be relatively fixed to the housing 1 of the lid, with the guide column 35 being provided as part of the fixing body 36. The fixing body 36 may be provided with an opening for adopting a movable shaft 24. The guide column 35 may be provided to guide up-and-down movements of the movable plate 16. Additional detail of the fixing body 36 and the guide column 35 will be discussed below. A switch device 18 and a security device 17 are installed on the fixing body 36 and the guide column 35. A guide plate 13, an insertion plate 10 and a buckle plate 12 are installed in the lid. A concave ring 45 and a guide strip 46 are provided on the outer side of the lid opening 11. A convex ring 20, a guide slot 21 and a latch 19 are provided on the inner side of the threaded body 5, the threaded body 5 is provided on the outside of the lid opening 11, the convex ring 20 is connected with the concave ring 45 of the lid opening 11, the guide slot 21 is connected with the guide strip 46 of the lid opening 11, the concave ring 45 of the lid opening 11 is engaged with the convex ring 20 of the threaded body 5 so as to prevent the separation of the threaded body 5 from the lid opening 11, the guide strip 46 of the lid opening 11 are engaged with the guide slot 21 of the threaded body 5 so as to prevent the rotation of the threaded body 5 on the lid opening 11, ribs 23 and threads 22 are provided on the outer side of the threaded body 5, and the press buckle 2 is installed above the vent 7. The switch device 18 is composed of a press plate 4 and a movable shaft 24. The movable shaft 24 is provided with a retaining ring 40 at the front end, a top ring 41 and a slot column 42 in the middle, and a seal block 25, a second spring 14B and a movable plate 16 in the rear portion. A seal ring 15 is mounted on the seal block 25, and a rubber ring 8 is installed between the top ring 41 and the slot column 42. The rubber ring 8 can be installed or removed without the need for tools and the switch device 18 can be directly assembled or disassembled by hand. The first spring 14A is installed on the slot column 42. The top ring 41 and the retaining ring 40 are installed between the guide plate 13. The guide plate 13 is connected to the housing 1. A long slot is provided on the guide plate 13. An insertion body 29 is installed within the long slot. The top ring 41 and the retaining ring 40 are provided on the insertion body 29. The security device 17 is composed of a button 3 and the movable plate 16 and is provided in the press plate 4. A second concave cavity 34B is provided on the press plate 4. The button 3 is provided on the second concave cavity 34B. A blocking plate 39, a fixing column 38 and a square hole 37 are provided on the movable plate 16. A second spring 14B is provided on the fixing column 38. The button 3 is provided with a non-slip strip 43 and a square body 44, and the square body 44 is connected with the square hole 37 on the movable plate 16. One end of the buckle plate 12 is provided with a shaft hole 30 and the other end is provided with a card slot 31. The insertion plate 10 is provided with two circular holes 28 at one end thereof, an insertion body 29 at the other end, and a rotating shaft 27 in the middle, the rotating shaft 27 is connected with the shaft hole 30 of the buckle plate 12, the insertion body 29 is connected with the guide plate 13 inside the lid, and the insertion plate 10 is connected with the top plate 9. The top plate 9 is provided with a soft edge 32 and a pin 33, the pin 33 is connected with the circular hole 28 on the insertion plate 10, the soft edge 32 is provided on the back of the water outlet 6, and the card slot 31 on the buckle plate 12 is fastened on the latch 19 of the lid. When people need to drink tea, people just use one hand to pick up the lid of the thermal insulated container, press the button 3 on the lid with the thumb and slide it downwards at the same time, the top plate 9 inside the lid will leave the back of the water outlet 9, tea will flow out of the water outlet 6, and people can drink the required tea.

Figure 7:
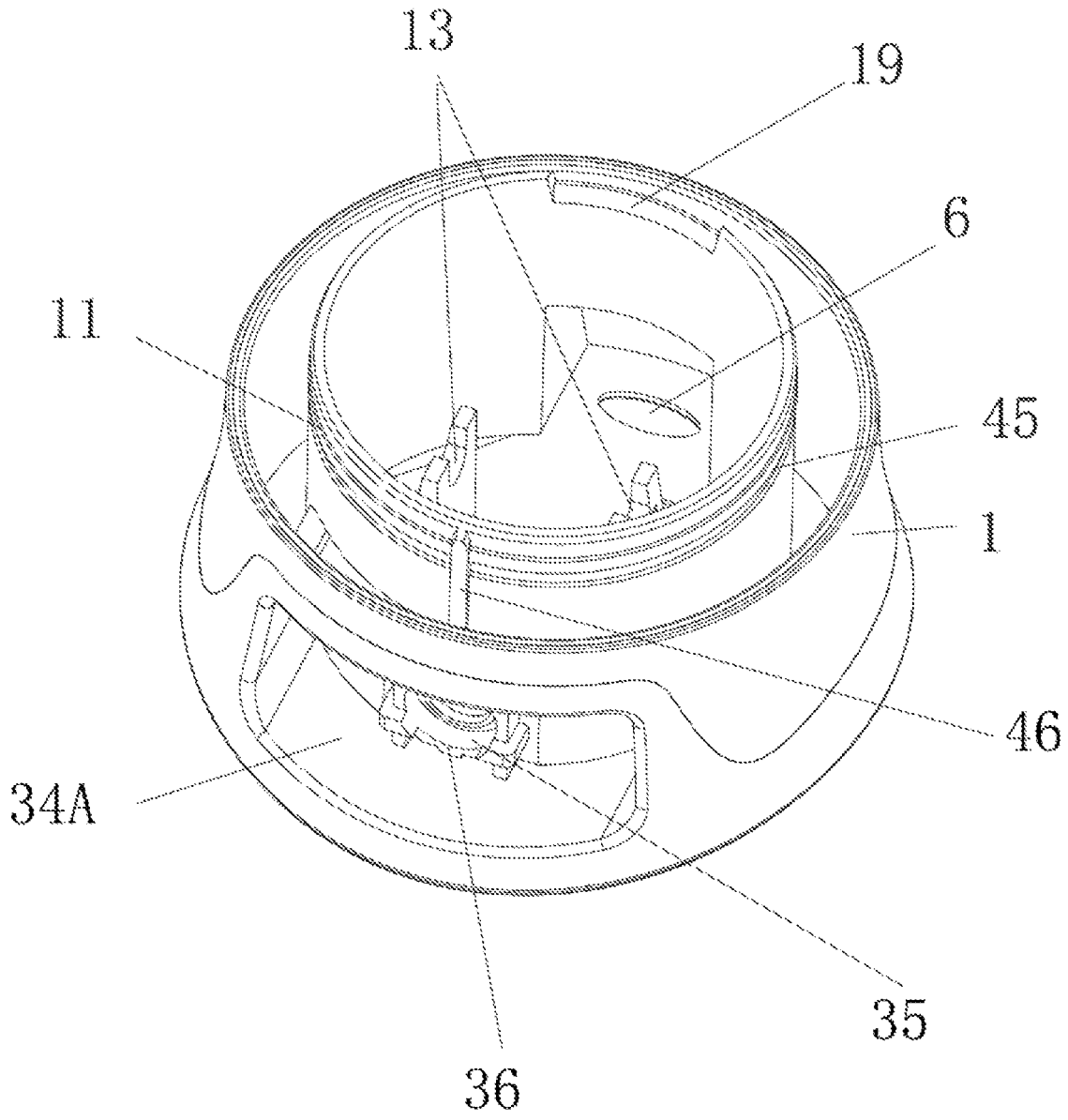
FIG. 7 is a schematic structural view showing a disassembled state of the present disclosure.
Figure 8:
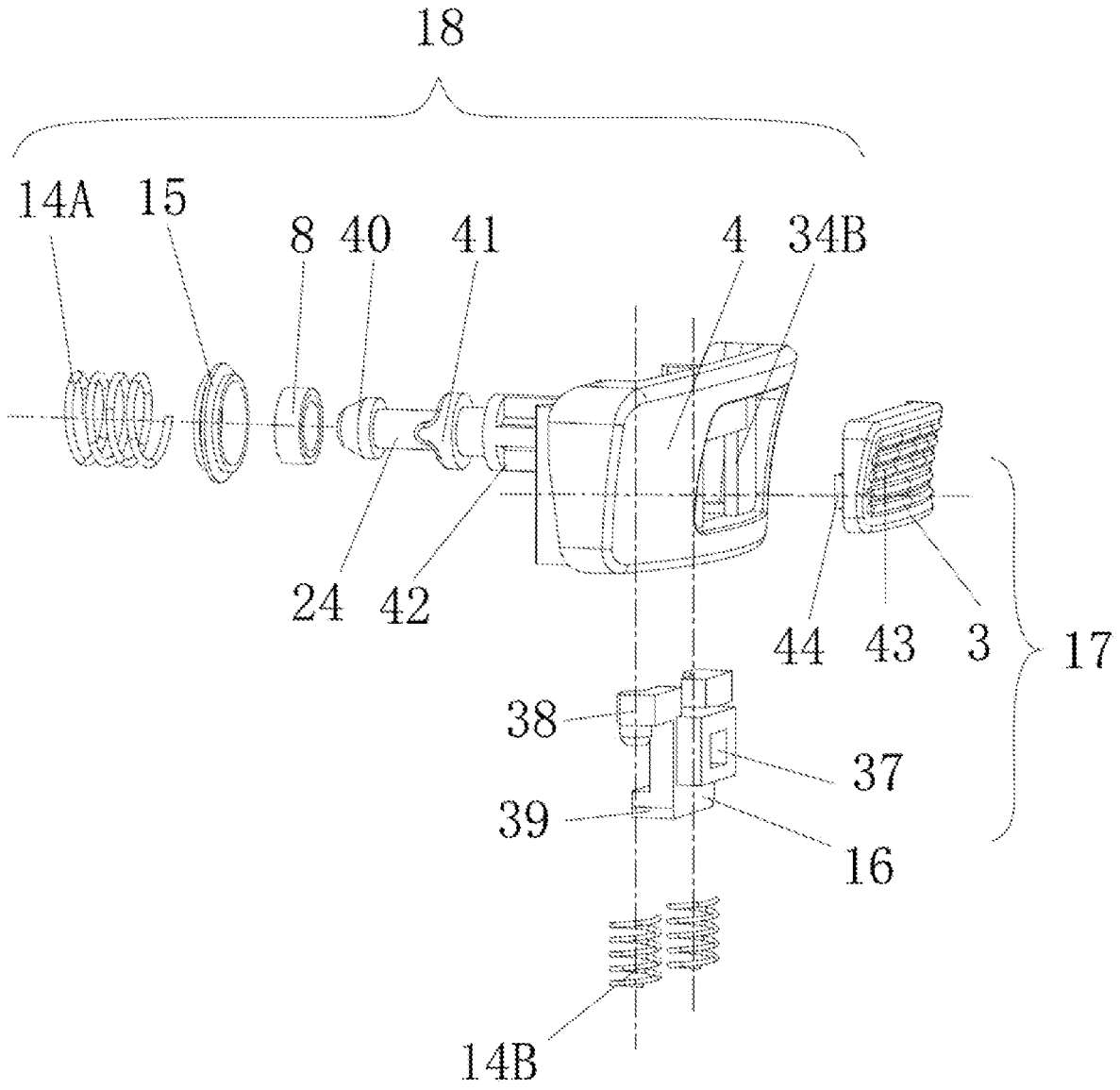
FIG. 8 is an exploded view showing the switch device and the security device in the present disclosure.
Figure 9:
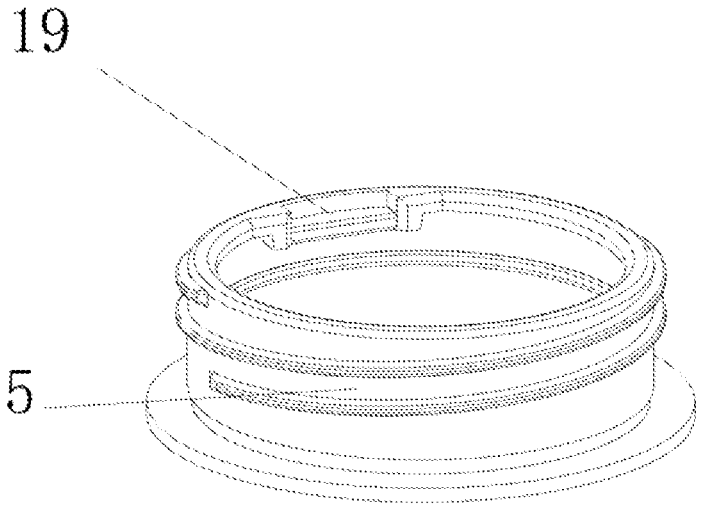
FIG. 9 is a second schematic structural view of the threaded body in the present disclosure.
Figure 11A:
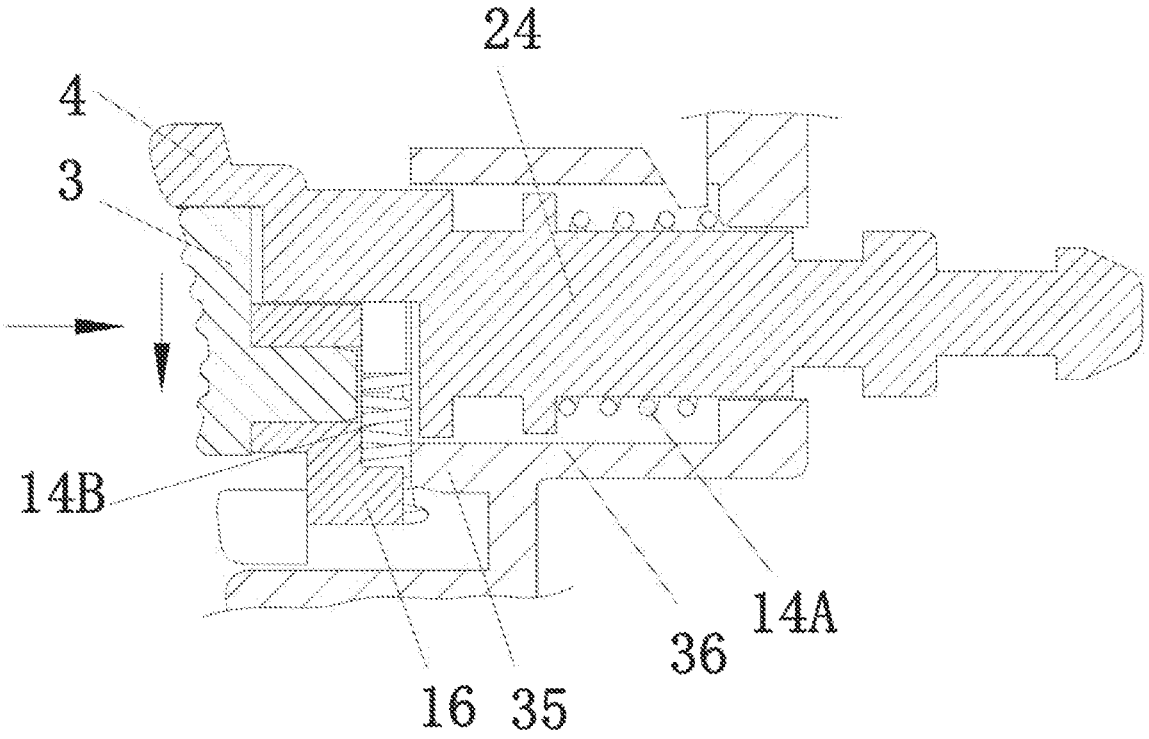
FIG. 11A is a sectional view showing an interaction of the fixing body with other structures of the lid before the button is pressed.
Figure 11B:
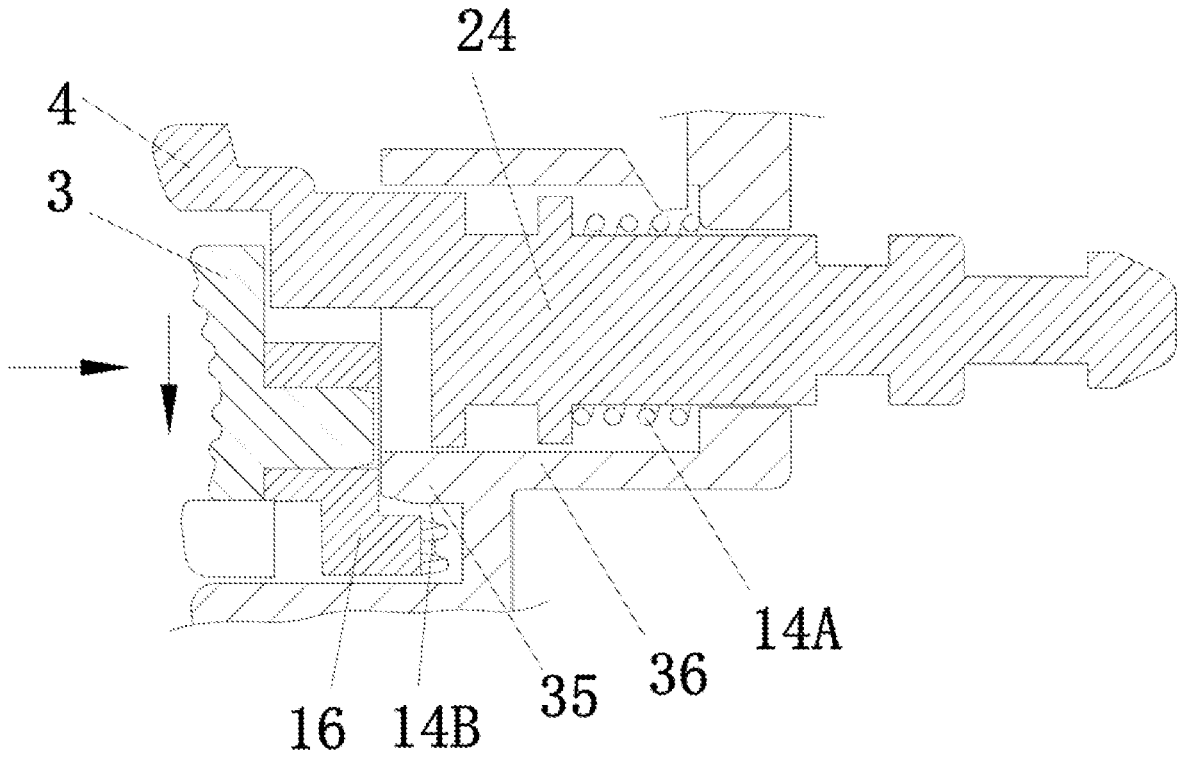
FIG. 11B is a sectional view showing an interaction of the fixing body with other structures of the lid after the button is pressed.

In FIG. 7, the first concave cavity 34A is provided on the side of the housing 1 of the lid, the fixing body 36 and the guide column 35 are installed in the first concave cavity 34A, and the guide plate 13 and the water outlet 6 are installed in the lid. FIG. 11A and FIG. 11B are sectional views showing the interaction process of the fixing body 36 with other structures of the lid. The fixing body 36 may be provided with an opening to adopt the movable shaft 24, when pressing the button 3, the movable shaft 24 is driven to move inward along a horizontal direction due to the compression of the first spring 14A, and the movable plate 16 is driven to move downward to compress the second spring 14B until the lower part of the movable plate 16 is located under the guide column 35.

Figure 10:
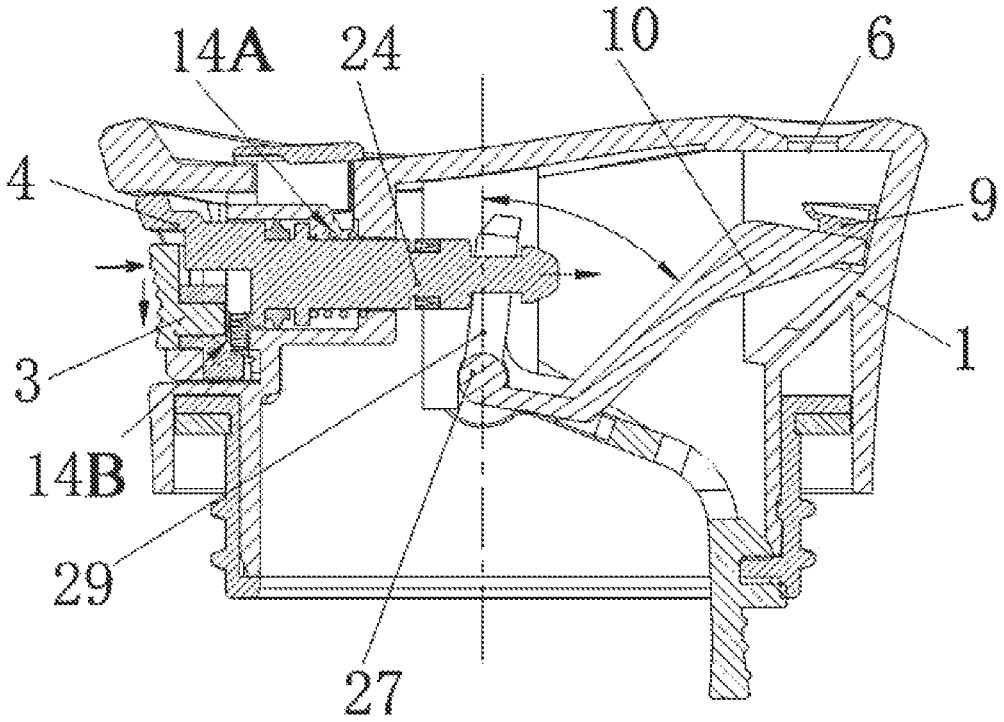
FIG. 10 is a dynamic diagram of the present disclosure.

In FIG. 10, since the press plate 4 and an upper part of the button 3 are each provided with an inwardly inclined body, when the press plate 4 and the button 3 are pushed inward by a thumb, the button 3 and the movable plate 16 will naturally or consciously move downward to bend the second spring 14B, and then the upper part of the button 3 will move downward until contacted and stopped by the guide column 35; in such a position, the lower part of the movable plate 16 can be located under the guide column 35 (illustrated in FIG. 11B) so that the button 3 can move inward. At the same time, the press plate 4 is also pushed inward, so that the insertion body 29 is pushed by the movable shaft 24 on the press plate 4 to rotate around the rotating shaft 27. Because the insertion body 29, the insertion plate 10 and the rotating shaft 27 are integral, the insertion body 10 is driven by the insertion plate 29 to rotate therewith. Since the top plate 9 is mounted at the top of the insertion plate 10, the top plate 9 leaves the water outlet 6 as soon as the top plate 9 hits the housing 1, and then the tea can flow into the water outlet 6. When the thumb leaves the press plate 4 and the button 3, the press plate 4 is restored under the action of the first spring 14A located on the movable shaft 24. Meanwhile, under the action of the second spring 14B which is straightened from a bending state, the movable plate 16 and the button 3 moves upward to a restored position, i.e., the the movable plate 16, the press plate 4 and the button 3 moves back to their initial positions respectively.

Although the present disclosure has been described above in detail with general description and specific embodiments, it is obvious to those skilled in the art that some modifications or improvements can be made on the basis of the present disclosure. Therefore, these modifications or improvements made without departing from the spirit of the present disclosure all fall within the protection scope of the present disclosure.

What is claimed is:

1. A convenient lid, comprising a housing, a lid opening, a press plate, a button, a threaded body, a water outlet and a press buckle, wherein the press buckle is provided on an upperpart of the housing, the press buckle is provided with a buckle foot, the lid opening and the threaded body are provided on a lower part of the housing, a side of the convenient lid is provided with a first concave cavity, a fixing body and a guide column are provided in the first concave cavity, a switch device and a security device are provided on the fixing body and the guide column;

the switch device comprises the press plate and a movable shaft;

the security device comprises the button and a movable plate and is provided in the press plate;

a retaining ring is located at a front end of the movable shaft, a top ring and a slot column are located at a middle of the movable shaft, a seal block, a first spring, and the movable plate are located at a rear portion of the movable shaft, the seal block is provided with a seal ring, a rubber ring is provided between the top ring and the slot column, the first spring is provided on the slot column;

a blocking plate, a fixing column, and a square hole are provided on the movable plate, wherein a second spring is provided on the fixing column, a non-slip strip and a square body are provided on the button, the square body is connected to the square hole on the movable plate;

a guide plate, an insertion plate, and a buckle plate are provided inside the convenient lid, wherein the guide plate is provided with a long slot, an insertion body is provided within the long slot, the top ring and the retaining ring are provided on the insertion body, the guide plate is provided within the housing, a second concave cavity is provided on the press plate, the button is provided in the second concave cavity, the press buckle is provided above a vent, a concave ring and a guide strip are provided on an outside of the lid opening, and a convex ring, a guide slot and a latch are provided on an inner side of the threaded body.

2. The convenient lid according to claim 1, wherein a rib and a thread are provided on an outer side of the threaded body.

3. The convenient lid according to claim 1, wherein the buckle plate is provided with a shaft hole and a card slot, the shaft hole is located at a first end of the buckle plate and the card slot is located at a second end of the buckle plate.

4. The convenient lid according to claim 3, wherein the insertion plate is provided with a circular hole, the insertion body and a rotating shaft, the circular hole is located at a first end of the insertion plate, the insertion body is located at a second end of the insertion plate, and the rotating shaft is located in a middle of the insertion plate, the rotating shaft is connected with the shaft hole of the buckle plate.

5. The convenient lid according to claim 4, wherein the insertion body is connected with the guide plate within the convenient lid.

6. The convenient lid according to claim 4, wherein the insertion plate is connected with a top plate, the top plate is provided with a soft edge and a pin, the pin is connected with the circular hole on the insertion plate, and the soft edge is provided on a back of the water outlet.

7. The convenient lid according to claim 3, wherein the card slot on the buckle plate is fastened on the latch of the threaded body.

* * * * *